US008807361B2

(12) United States Patent
Luo

(10) Patent No.: US 8,807,361 B2
(45) Date of Patent: Aug. 19, 2014

(54) SAFE SEALING CAP FOR CONTAINER

(75) Inventor: Shize Luo, Guangdong (CN)

(73) Assignee: Shantou Hongqiao Packaging Industry Co., Ltd., Jinping District, Shantou, Guangdong (CN)

( * ) Notice: Subject to any disclaimer, the term of this patent is extended or adjusted under 35 U.S.C. 154(b) by 105 days.

(21) Appl. No.: 13/383,415

(22) PCT Filed: Dec. 19, 2011

(86) PCT No.: PCT/CN2011/084193
§ 371 (c)(1),
(2), (4) Date: Apr. 24, 2012

(87) PCT Pub. No.: WO2013/082833
PCT Pub. Date: Jun. 13, 2013

(65) Prior Publication Data

US 2013/0153528 A1 Jun. 20, 2013

(30) Foreign Application Priority Data

Dec. 8, 2011 (CN) ..... 2011 1 0406628

(51) Int. Cl.
*B65D 41/34* (2006.01)

(52) U.S. Cl.
USPC ..... 215/252; 220/265; 222/153.06

(58) Field of Classification Search
CPC ..... B56D 41/3404; B65D 51/24
USPC ..... 215/250, 252, 218, 221, 217, 216, 253, 215/44, 329; 220/268, 269, 266, 265; 222/153.05, 153.06
See application file for complete search history.

(56) References Cited

U.S. PATENT DOCUMENTS 8,443,999 B1 * 5/2013 Reinders ..... 220/303
8,528,757 B2 * 9/2013 Bisio ..... 215/252

* cited by examiner

*Primary Examiner* — Mickey Yu
*Assistant Examiner* — Allan Stevens
(74) *Attorney, Agent, or Firm* — Global IP Services; Tianhua Gu

(57) ABSTRACT

The present invention directs a safe sealing cap for container, having a sealing cap body and at least a secure component, the secure component includes a curved part, a swinging support and a retaining plate, the swinging support is fixed on the outer wall of the sealing cap body, the back end of the curved part is fixed on the bottom side of the front end of the swinging support, the back end of the retaining plate is fixed on the inner wall of the back end of the curved part, and the front end of the retaining plate is extended towards the sealing cap body; the safe sealing cap further comprises at least two protection components, the protection components are connected to the sealing cap body respectively, and the protection components are successively arranged on the sealing cap body in the circumferential direction thereof.

10 Claims, 9 Drawing Sheets

SAFE SEALING CAP FOR CONTAINER

FIELD OF THE INVENTION

The present invention relates to a sealing element of the filling tube of the container, more particular, for a safe sealing cap of the container which could prevents young child or infant from swallowing the cap.

BACKGROUND OF THE INVENTION

The existing containers, particular for some small-volume containers, are equipped with filling tubes characteristic of small diameter, thus the size of this kind of sealing cap of the filling tube is small too.

Because the young child or the infant usually prefer to put things into their mouth, once these small-size sealing cap is swallowed down by them, the sealing cap is easy to choke up their windpipe, which ventures their lives.

The bottom end of the sealing cap is usually equipped with a secure ring. The object of the secure ring is to prevent the stuff within the container from undergoing deterioration as the sealing cap is open by some people before using, meanwhile the container also could be avoided secondary utilization, and the secure ring serves the function of reminder, security and anti-counterfeiting.

The secure ring usually includes several curved components, and the curved components are arranged into a ring shape successively, two adjacent curved components are coupled to each other via a connecting strip, with the height of the connecting strip being much lower than that of curved component, owing to the low height of the connecting strip, the connecting strip would be easier to be ruptured compared with the curved component. When the user twists the cap off, the retaining plate formed on the inner sidewall of the curved component is blocked by the stopper formed on the outer sidewall of the filling tube of the container, so as to protrude outside. As such, the user would know about whether the secure ring is broken and sealing cap is open via observing.

The drawback of the secure ring is that: when the curved component of the secure ring is distorted, the distorting movement is carried out outwards in radial direction of the sealing cap, thus the appearance difference between the broken secure ring and the unchanged one is so limited, which make people hard to tell whether the secure ring is open, and easy to cause a wrong judgment. Furthermore, every curved component is completely exposed outside the sealing cap, which makes young child or the infant easy to fetch to swallow them in.

SUMMARY OF THE INVENTION

The objective of the present invention is to provide a safe sealing cap for container, and the container could advantageously prevent the secure component from disassembling by the children or the infant, and prevent the whole safe sealing cap or some secure components from swallowing down. The technical solution of the present invention is as follow:

To achieve the above-mentioned objects, the present invention provides a safe sealing cap for container, having a sealing cap body and at least a secure component, wherein the secure component includes a curved part, a swinging support and a retaining plate, the back end of the swinging support is fixed on the outer wall of the sealing cap body, the top side of the back end of the curved part is fixed on the bottom side of the front end of the swinging support, the back end of the retaining plate is fixed on the inner wall of the back end of the curved part, and the front end of the retaining plate is extended towards the sealing cap body; the safe sealing cap further includes at least two protection components, the protection components are connected to the sealing cap body respectively, and the protection components are successively arranged on the sealing cap body in the circumferential direction thereof. The secure component being in distortion or not allows the user to know whether the safe sealing cap body is open up. Also, the protection components enable the size of the safe sealing cap to be larger, which could not be put in the mouth. The reason why the protection components are employed instead of using big lid is as follow: when the stuff filled in the container is used up, the value of the safe sealing cap is completely worked out, and the safe sealing cap is hard to reclaim and does great damage to the environment. If a big lid is designed to cover the sealing cap body, the material used in the sealing cap is so much that the environment spoiled thereby. However, adding protection components into the sealing cap could enable the material thereof to be used as less as possible, via designing the protection components with reasonable size according to the actual requirement, so as to reduce the damage to the environment.

In order to beef up the rigidity of the swinging support, a reinforcing plate is arranged on the top side of the joint between the swinging support and the curved part.

In order to aid users to tell apart whether the curved part is disrupted, the safe sealing cap further includes at least a curved reference component, the top side of the curved reference component is fixed on the bottom side of the protection component. In a preferable embodiment, the curved reference component and the curved part constitute a secure ring. Before the cured part is not yet distorted, people could not see through the secure ring in the horizontal direction. When people overlook the secure ring, a ring could be seen. When the cured part is distorted, big gaps could be seen in the secure ring in the horizontal direction. When people overlook the secure ring, notches could also be seen in the secure ring. Therefore, users are able to tell apart whether the curved part is disrupted easily.

The curved part and the curved reference component are arranged corresponding to each other and the number thereof are identical, a bulge is arranged on the front end of the curved part, a recess is formed at the back end of the curved reference component, the bulge and the recess are arranged corresponding to each other, and the bulge is engaged with the recess correspondingly. As such, the secure ring composed of the curved part and the curved reference component are more completed, and the recess could limit the direction in which the curved part rotated when the curved part is distorted, so that the bulge arranged on the front end of the curved part is merely moved upwards the outside of the sealing cap body when the curved part is distorted, and all most parts of the curved part slide into the space between the sealing cap body and the protection components. Thus, the curved part is hard to take down, so the secure component is prevented from taking down by children or infant.

Through holes are formed between the top end and bottom end of the protection components. As such, when young children or the infant swallow down the sealing cap in mistake, the through holes serve the function of venting. Further, the through holes could save the material used in the protection components, so as to reduce the production cost, and the through holes are therefore made into more flexibility, which easy to be grasped, and reduce the harm to the users.

In the preferable embodiment, the protection components are arranged on the sealing cap body in the circumferential direction thereof to form a ring shape. Such structure facilitates the users to twist to open or close the safe sealing cap of the container, and the protection components could surround the sealing cap to prevent the children form touching the secure component.

Two outside surfaces of every two adjacent protection components are formed a slot. In order to employ the safe sealing cap of the container into the connection game, some plug-in members whose shape is corresponding to the slots are designed to insert into the slots between any two adjacent protection components, such plug-in members could be connected to the safe sealing cap of the container, which enables the safe sealing cap possess the function of connecting toys. If the plug-in member is fixed on the other cap, then these two kinds of caps could be employed into the connecting games. This safe sealing cap of the container possesses new game functions, which add the additional value to it, when the stuff in the container is used up, the safe sealing cap would not be thrown away optionally since the safe sealing cap is loss its value, and would not damage the environment.

In order to avoid the fingers skidding on the safe sealing cap and could not open the safe sealing cap when twisting to open or close the cap, skidproof grooves are formed on the outside surface of the protection components.

In the preferable embodiment, at least a skidproof pattern is arranged on the outside surface of the protection components. The skidproof pattern could improve the frictional force between the fingers and the outside surface of the protection components, which avoids the user figure skidding and making safe sealing cap being open available.

In comparison with the prior art, due to the secure ring is composed of the secure component and the curved reference component, the visual difference lied between the curved part and the curved reference component after distortion which produced in axial direction of the sealing cap body, enables the user to tell apart whether the secure ring is complete or not easily; because the protection components are added, the sealing cap body with small size would not be swallowed down by the young children or the infant, the safety performance of the safe sealing cap will be improved advantageously; since the plug-in member could be inserted into the recess between any two adjacent protection members, the safe sealing cap of the container possesses the connecting game function, the use value of the safe sealing cap is greatly improved, when the stuff within the container is used up, the safe sealing cap would not be thrown away optionally since the safe sealing cap is lost its value, and would not damage the environment.

Other aspects, features, and advantages of this invention will become apparent from the following detailed description, by way of example, principles of this invention.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
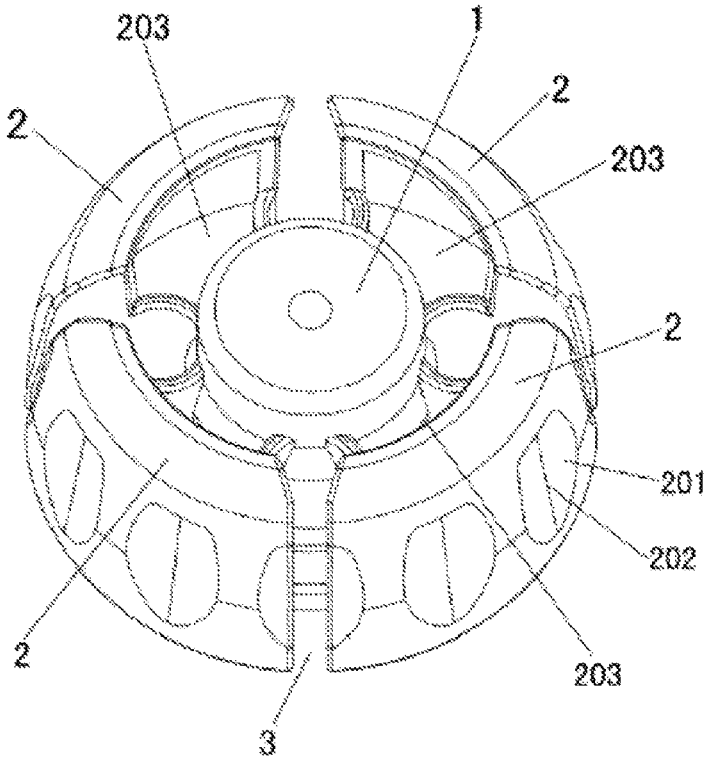
FIG. 1 is a schematic illustration of the safe sealing cap of an embodiment of the invention.

Various preferred embodiments of the invention will now be described hereinafter.

As shown in FIGS. 1-11, the safe sealing cap for container according to the present invention includes a sealing cap body 1, four secure components 401, four curved reference components 402 and four protection components 2, four protection components 2 are respectively connected to the sealing cap body 1, and the protection components 2 are successively arranged on the sealing cap body 1 in its circumferential direction.

The secure component 401 includes a curved part 4011, a swinging support 4012 and a retaining plate 4013, the back end of the swinging support 4012 is fixed on the outer wall of the sealing cap body 1, the top side of the back end of the curved part 4011 is fixed on the bottom side of the front end of the swinging support 4012, the back end of the retaining plate 4013 is fixed on the inner wall of the back end of the curved part 4011, and the front end of the retaining plate 4013 is extended towards the sealing cap body 1.

In order to beef up the rigidity of the swinging support 4012, a reinforcing plate 4014 is arranged on the top side of the joint between the swinging support 4012 and the curved part 4011.

Figure 2:
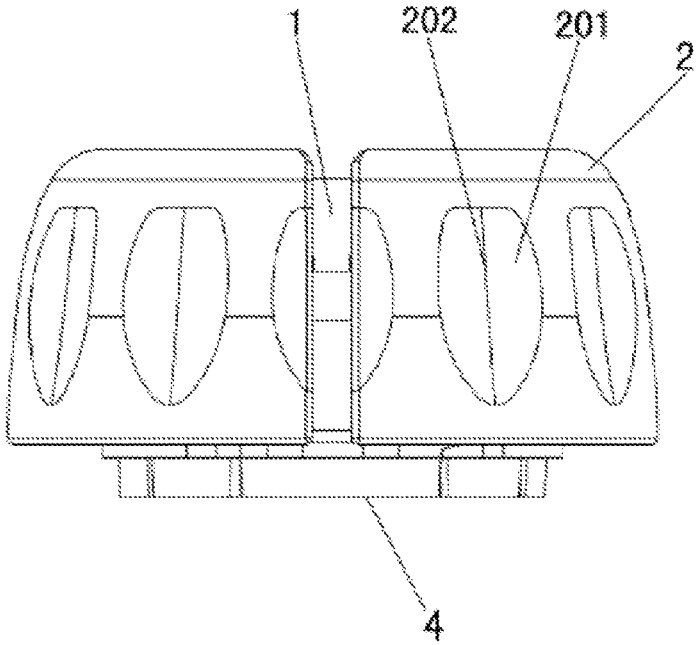
FIG. 2 is a front view illustrating the safe sealing cap shown in FIG. 1 of an embodiment of the invention.
Figure 3:
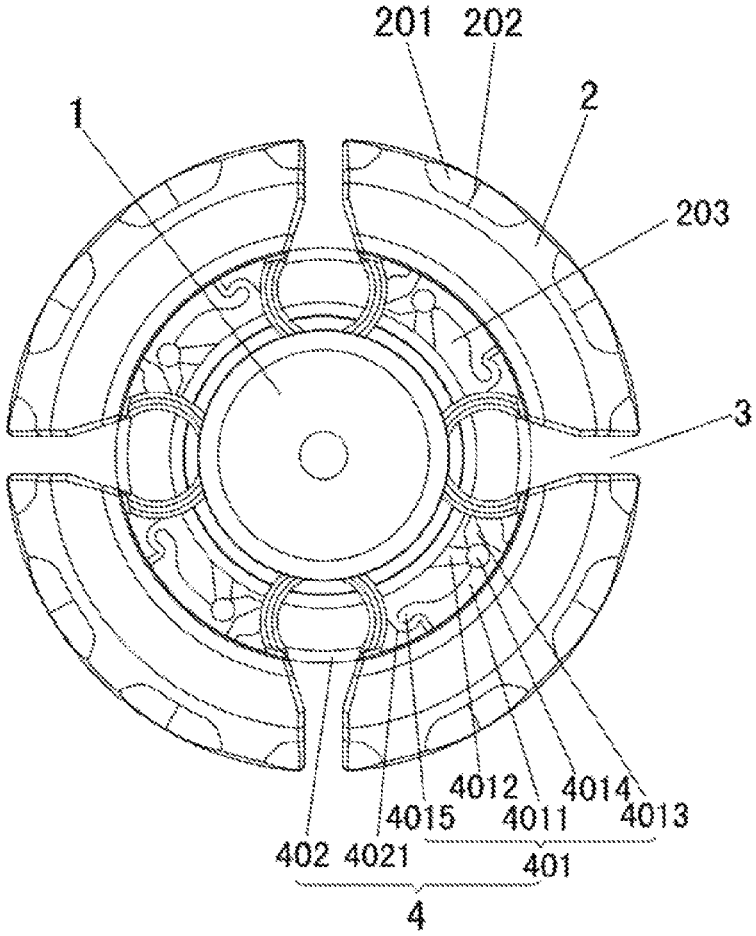
FIG. 3 is a top view illustrating the safe sealing cap shown in FIG. 1 of an embodiment of the invention.
Figure 4:
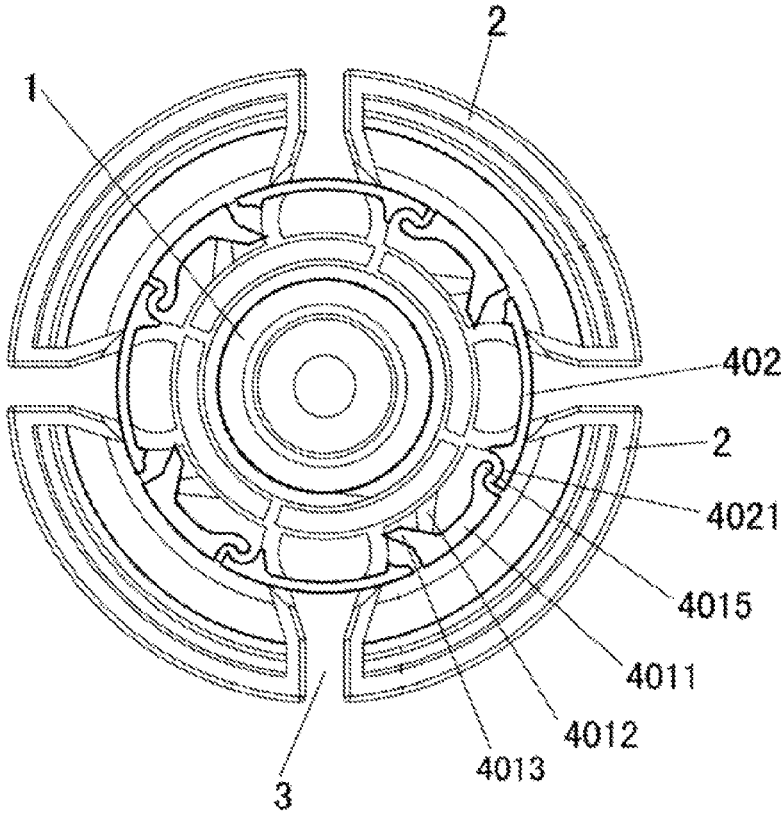
FIG. 4 is a bottom view illustrating the safe sealing cap shown in FIG. 1 of an embodiment of the invention.
Figure 5:
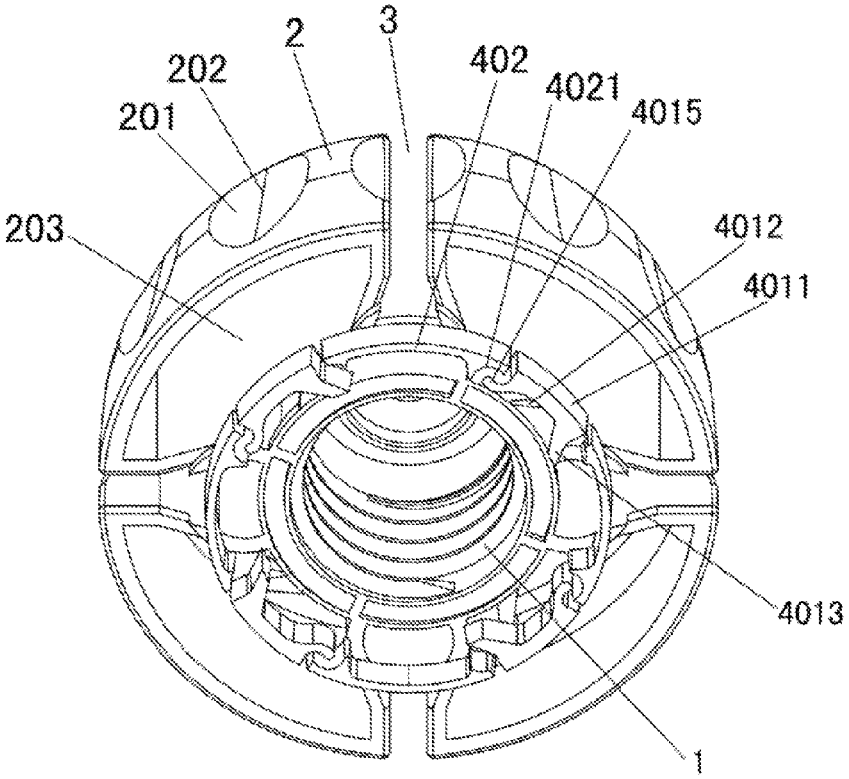
FIG. 5 is a schematic illustration of the safe sealing cap shown in FIG. 1 of an embodiment of the invention from another angle.
Figure 6:
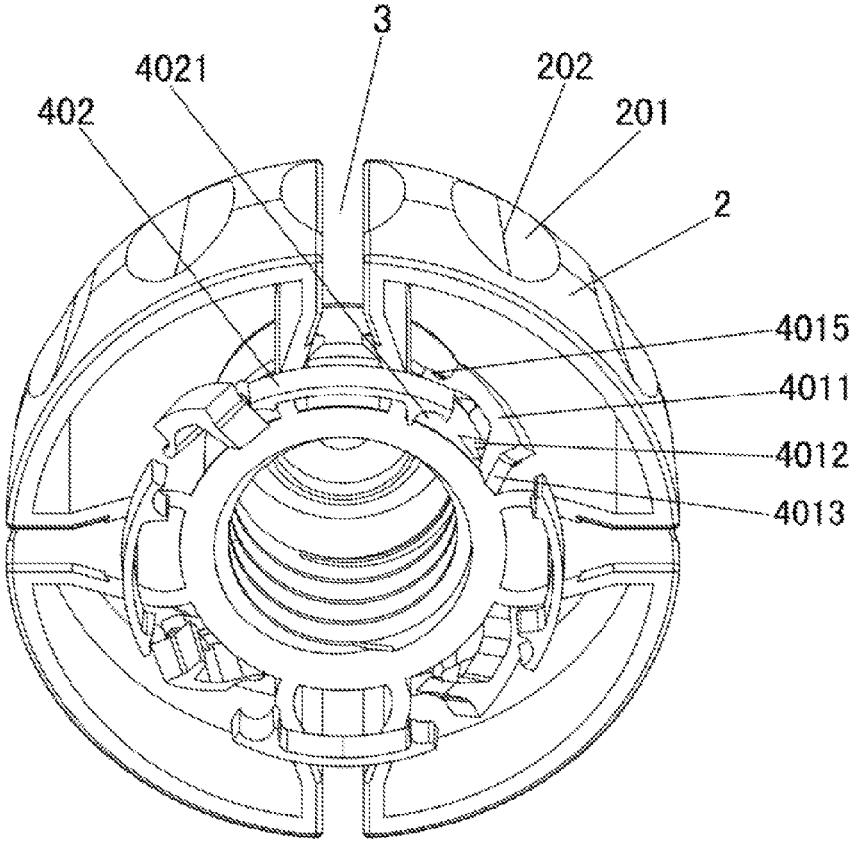
FIG. 6 is a schematic illustration of the safe sealing cap shown in FIG. 1 with the distorted curved part of an embodiment of the invention.
Figure 7:
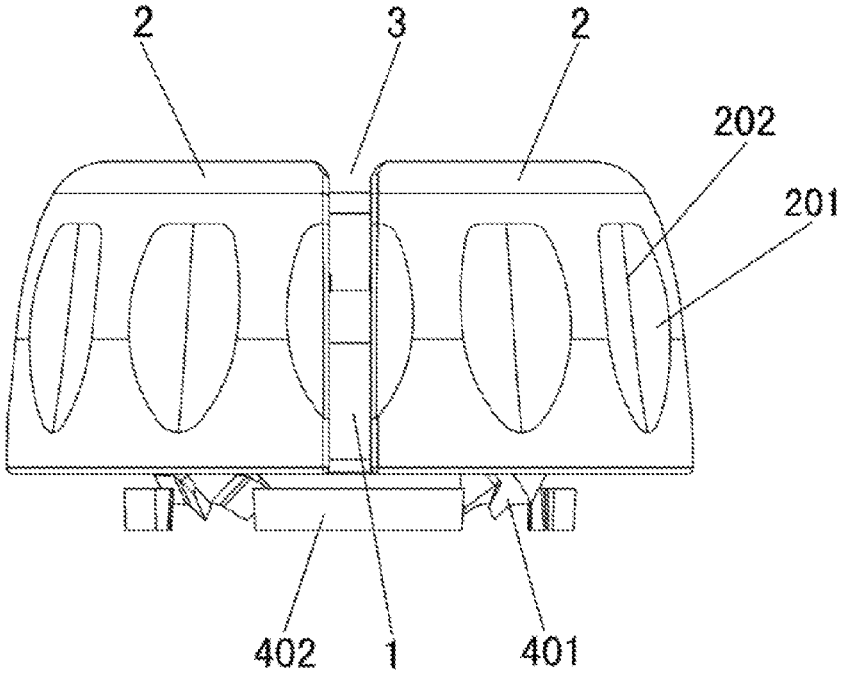
FIG. 7 is a front view illustrating the safe sealing cap shown in FIG. 1 with the distorted curved part of an embodiment of the invention.
Figure 8:
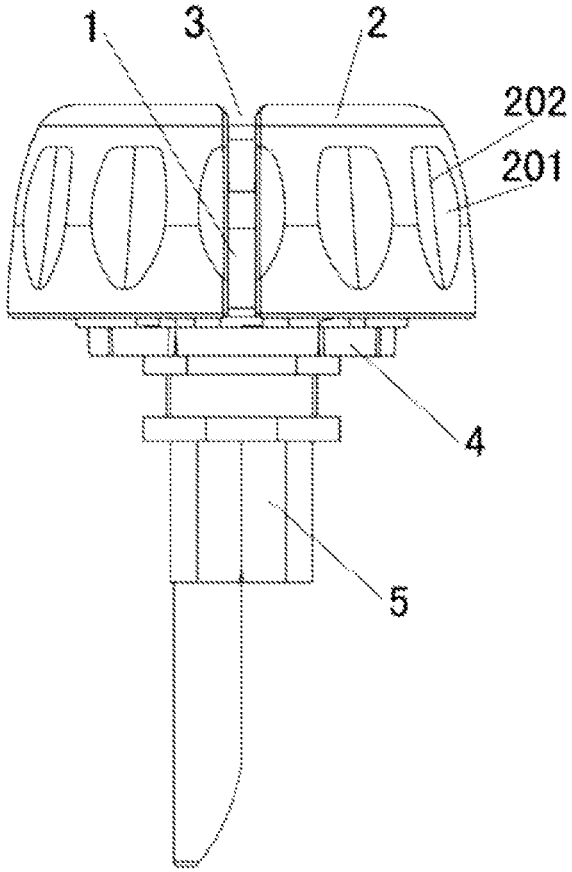
FIG. 8 is a front view illustrating the safe sealing cap shown in FIG. 1 mounting on the filling tube of an embodiment of the invention.
Figure 9:
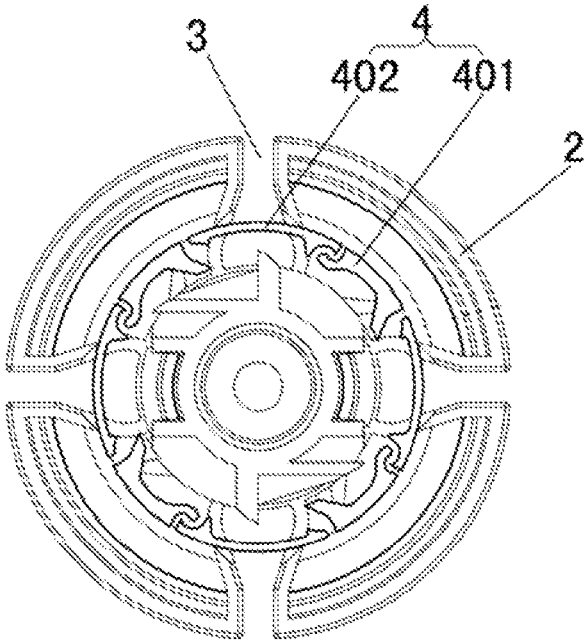
FIG. 9 is a bottom view illustrating the safe sealing cap shown in FIG. 1 mounting on the filling tube of an embodiment of the invention.
Figure 10:
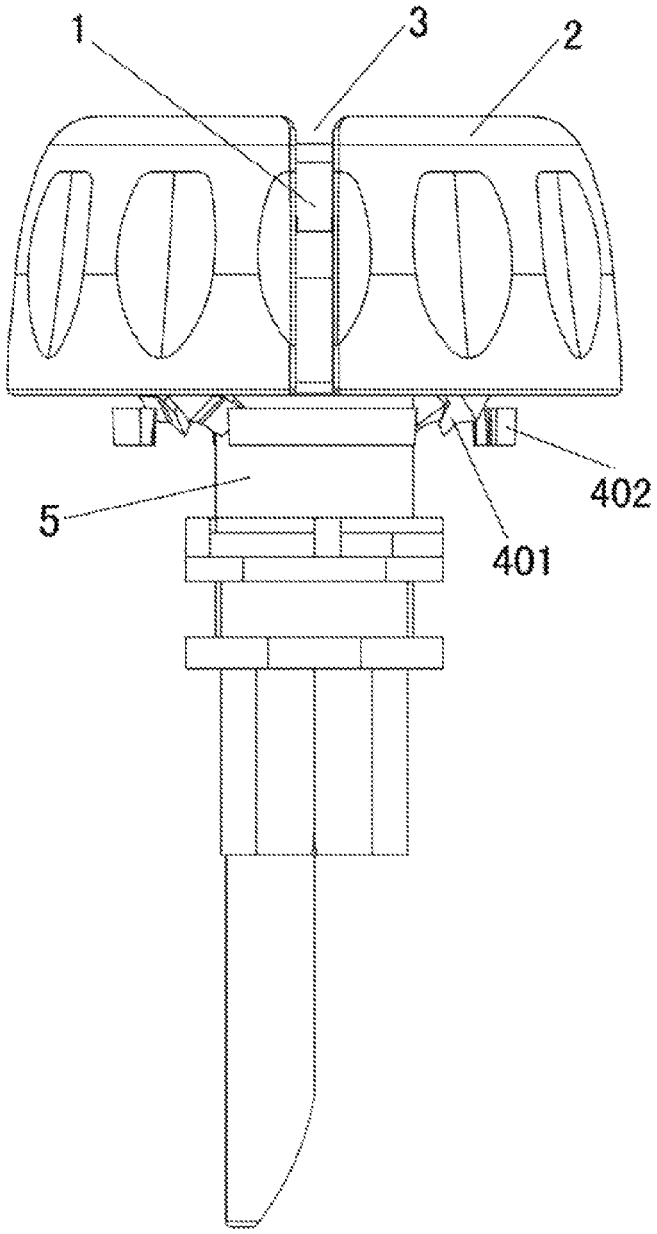
FIG. 10 is a front view illustrating the safe sealing cap shown in FIG. 1 mounting on the filling tube after the safe sealing cap is twist to open of an embodiment of the invention.
Figure 11:
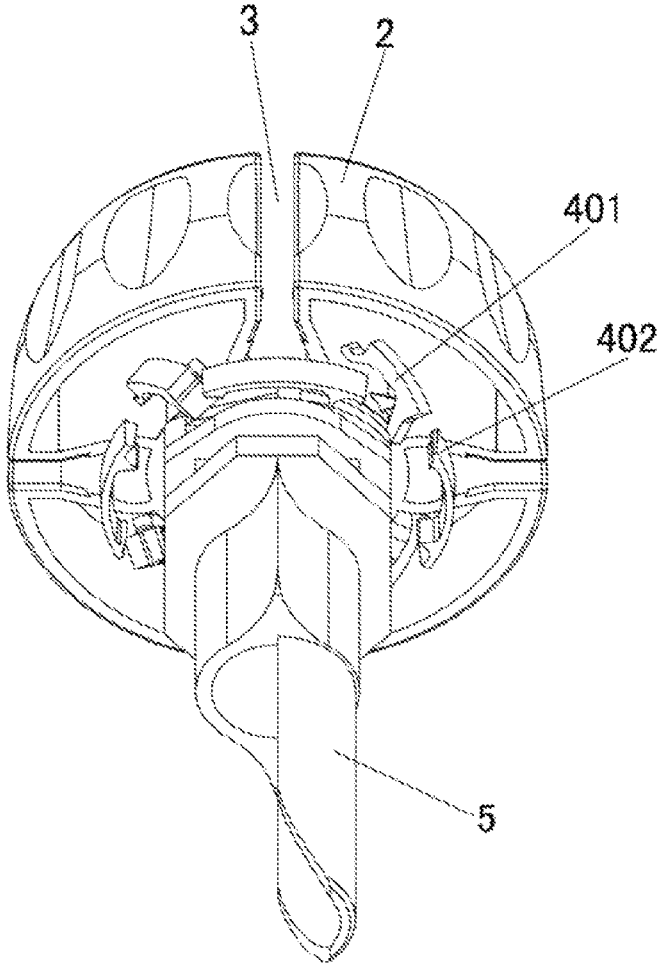
FIG. 11 is a schematic illustration of the safe sealing cap shown in FIG. 1 mounting on the filling tube after the safe sealing cap is twisted to open of an embodiment of the invention.

The top side of curved reference component 402 is fixed on the bottom side of the protection component 2, the curved reference component 402 and the curved part 4011 are arranged alternately in turn to constitute a secure ring 4. Referring to FIGS. 2 and 8, before the cured part 4011 is not yet distorted, people could not see through the secure ring 4 in the horizontal direction. Referring to FIGS. 3 and 9, when people overlook the secure ring 4, a secure ring 4 composed of four curved reference components 402 and four secure parts 401 which are arranged alternately in turn could be seen. Referring to FIGS. 7 and 10, when the cured part 4011 is distorted, big gaps could be seen in the secure ring 4 in the horizontal direction. When people overlook the secure ring 4, notches could also be seen in the secure ring obviously. Referring to FIGS. 6 and 11, the change of the secure ring 4 is evidently seen from the schematic illustrations. Therefore, users are able to tell apart whether the curved part is disrupted or not easily.

The curved part 4011 and the curved reference component 402 are arranged corresponding to each other and the number thereof are identical, a bulge 4015 is arranged on the front end of the curved part 4011, a recess 4021 is formed at the back end of the curved reference component 402, the bulge 4015 and the recess 4021 are arranged corresponding to each other, and the bulge 4015 is engaged with the recess 4021 correspondingly. As such, the secure ring 4 composed of the curved part 4011 and the curved reference component 402 are more completed, and the recess 4021 could limit the direction in which the curved part 4011 rotated when the curved part 4011 is distorted, so that the bulge 4015 arranged on the front end of the curved part 4011 is merely moved upwards the outside of the sealing cap body 1 when the curved part 4011 is distorted, and all most parts of the curved part 4011 slide into the space between the sealing cap body 1 and the protection components 2. Thus, the curved part 4011 is hard to take down, so the secure component 401 is prevented from taking down by children or infant.

Through holes 203 are formed between the top end and bottom end of the protection components 2. The protection components 2 are arranged on the sealing cap body 1 in its circumferential direction to form a ring shape. Such structure facilitates the user to twist to open or close the safe sealing cap of the container, and the protection components 2 could surround the sealing cap 1 to prevent the children or infant from taking down the secure components 401.

Two outside surfaces of every two adjacent protection components 2 are formed a slot 3. In order to employ the safe sealing cap of the container into the connection game, some plug-in members whose shape is corresponding to the slots 3 are designed to insert into the slots 3 between any two adjacent protection components 2, such plug-in members could be connected to the safe sealing cap of the container, which enables the safe sealing cap to possess the function of connecting toys. If the plug-in member is fixed on the other cap, then these two kinds of caps could be employed into the connecting games. This safe sealing cap of the container possesses new game functions, which adds the additional value to it, when the stuff in the container is used up, the safe sealing cap would not be thrown away optionally since the safe sealing cap is lost its value, and would not damage the environment.

In order to avoid the fingers skidding on the safe sealing cap and could not open the safe sealing cap when twisting to open or close the cap, skidproof grooves 201 are designed to form on the outside surface of the protection components 2.

In the preferable embodiment, at least a skidproof pattern 202 is arranged on the outside surface of the protection components 2. The skidproof pattern 202 could improve the frictional force between the fingers and the outside surface of the protection components 2, which avoids the user figure skidding and making safe sealing cap being open available.

In order to strengthen stability of the curved part 4011, the top side of one end of the retaining plate 4013 is connected to the protection components 2. Because the joint area is so small, the stability of the curved part 4011 is strengthened, and the retaining plate 4013 rotating about the swinging support 4012 via the stopper arranged on the outside wall of the filling tube 5 is not be impacted.

Referring to FIGS. 8 and 9, after the safe sealing cap is mounted on the filling tube 5, the curved reference component 402 and the curved part 4011 are arranged alternately in turn to form the secure ring 4. Referring to FIGS. 10 and 11, when the safe sealing cap of the container is twisted to open, and the safe sealing cap of the container is mounted on the filling tube 5 again, notches could be seen in the secure ring obviously. Since the front end of the curved part 4011 is turned upwards in axial direction of the sealing cap body when the curved part 4011 is distorted, just a fraction of the back end of the curved part 4011 remains outside, which it is hard for people to take down the curved part 4011, and the safety is greatly improved. The protection components 2 enlarge the size of the sealing cap, which advantageously avoids the situation that the children and the infant swallow down the safe sealing cap of the container. Furthermore, the slots 3 arranged between any two adjacent protection members 2 serve the function of connecting game of the safe sealing caps, and the value of the safe sealing cap is improved greatly.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A safe sealing cap for container, comprising a sealing cap body and at least a secure component, wherein the secure component comprises a curved part, a swinging support and a retaining plate, one end of the swinging support is fixed on an outer wall of the sealing cap body, a top side of one end of the curved part is fixed on a bottom side of an other end of the swinging support, one end of the retaining plate is fixed on an inner wall of the one end of the curved part, and an other end of the retaining plate is extended towards the sealing cap body; the safe sealing cap further comprises at least two protection components, the protection components are connected to the sealing cap body respectively, and the protection components are successively arranged on the sealing cap body in the circumferential direction thereof.

2. The safe sealing cap for container according to claim 1, wherein a reinforcing plate is arranged on a top side of a joint between the swinging support and the curved part.

3. The safe sealing cap for container according to claim 2, wherein the safe sealing cap further comprises at least a curved reference component, a top side of curved reference component is fixed on a bottom side of the protection component.

4. The safe sealing cap for container according to claim 3, wherein the curved reference component and the curved part constitute a secure ring.

5. The safe sealing cap for container according to claim 4, wherein the curved part and the curved reference component are arranged corresponding to each other and the number thereof are identical, a bulge is arranged on the other end of the curved part, a recess is formed at one end of the curved reference component, the bulge and the recess are arranged corresponding to each other, and the bulge is engaged with the recess correspondingly.

6. The safe sealing cap for container according to claim 1, wherein through holes are formed between a top end and a bottom end which is opposite to the top end of the protection components.

7. The safe sealing cap for container according to claim 6, wherein the protection components are arranged on the sealing cap body in the circumferential direction thereof to form a ring shape.

8. The safe sealing cap for container according to claim 7, wherein between each adjacent protection component there exists a slot.

9. The safe sealing cap for container according to claim 6, wherein skidproof grooves are formed on an outside surface of the protection components.

10. The safe sealing cap for container according to claim 6, wherein at least a skidproof pattern is arranged on an outside surface of the protection components.

* * * * *